US011058933B2

(12) United States Patent
Varshney et al.

(10) Patent No.: US 11,058,933 B2
(45) Date of Patent: Jul. 13, 2021

(54) GOLF PUTTER

(71) Applicant: V3ktor Golf LLC, Buffalo Grove, IL (US)

(72) Inventors: Viral Varshney, Buffalo Grove, IL (US); Kent Stevens, New Ulm, MN (US); Ken Schissel, Calmar, IA (US)

(73) Assignee: V3ktor Golf LLC, Buffalo Grove, IL (US)

( * ) Notice: Subject to any disclaimer, the term of this patent is extended or adjusted under 35 U.S.C. 154(b) by 0 days.

(21) Appl. No.: 15/929,315

(22) Filed: Apr. 24, 2020

(65) Prior Publication Data

US 2020/0346084 A1 Nov. 5, 2020

Related U.S. Application Data

(60) Provisional application No. 62/841,929, filed on May 2, 2019, provisional application No. 62/870,199, filed on Jul. 3, 2019.

(51) Int. Cl.

| | |
|---|---|
| ***A63B 53/04*** | (2015.01) |
| ***A63B 53/00*** | (2015.01) |
| *A63B 69/36* | (2006.01) |

(52) U.S. Cl.

CPC ..... *A63B 53/0487* (2013.01); *A63B 53/007* (2013.01); *A63B 53/0433* (2020.08); *A63B 53/0441* (2020.08); *A63B 69/3676* (2013.01); *A63B 69/3685* (2013.01)

(58) Field of Classification Search

CPC ..... A63B 53/0441; A63B 69/3685; A63B 53/0433; A63B 53/007; A63B 53/0487; A63B 69/3676

USPC ..... 473/340, 341, 344

See application file for complete search history.

(56) References Cited

U.S. PATENT DOCUMENTS

| | | | | |
|---|---|---|---|---|
| 1,467,714 A | | 9/1923 | Doerr | |
| 4,324,404 A | * | 4/1982 | Dian | A63B 53/007 473/340 |
| 4,749,196 A | * | 6/1988 | Podgor | A63B 69/3685 273/DIG. 14 |
| 4,962,931 A | * | 10/1990 | Jazdzyk, Jr. | A63B 69/3685 473/252 |
| 5,340,106 A | * | 8/1994 | Ravaris | A63B 53/0487 473/328 |

(Continued)

OTHER PUBLICATIONS

Website printout featuring photograph of 1923 putter.
Website printout featuring photograph of putter available at least as early as 2007.

*Primary Examiner* — Benjamin Layno
(74) *Attorney, Agent, or Firm* — Brian G. Gilpin; Godfrey & Kahn, S.C.

(57) ABSTRACT

A golf putter head that can improve the golfer's ability by providing function features that create a consistent setup of putter head position in relation to the golf ball and golfer position in relation to the putter. Once the setup is consistent, further increase in the consistency of the golfer's stroke can be attained through building muscle memory. From the putter stroke, the hitting face can impart an accurate forward motion to the golf ball upon being stricken by the putter head. The putter can provide tactile feedback to the golfer during the golf swing while imparting a forward roll to the golf ball upon striking and can simplify the visual alignment of the putter head to the golf ball.

4 Claims, 7 Drawing Sheets

(56) References Cited

U.S. PATENT DOCUMENTS

| | | | | |
|---|---|---|---|---|
| 5,928,088 | A * | 7/1999 | Matthews | A63B 53/0487 473/313 |
| 8,672,771 | B1 * | 3/2014 | Vlosich | A63B 53/065 473/251 |
| 9,265,997 | B1 * | 2/2016 | Good, Jr. | A63B 53/14 |

* cited by examiner

GOLF PUTTER

PRIORITY CLAIM AND CROSS-REFERENCE TO RELATED APPLICATION

This application is based on and claims priority to U.S. Provisional Patent Application Nos. 62/841,929 filed on May 2, 2019, and 62/870,199 filed on Jul. 3, 2019, both of which are incorporated herein by reference in their entireties for all purposes.

FIELD OF THE INVENTION

The present invention relates generally to the field of putting in the sport of golf. More particularly, the present invention relates to a putter that enhances putting accuracy and improves the putting ability of user through repeated use of the putter.

BACKGROUND

Putting in golf requires precision and accuracy and is often a result of the player's stroke on the putter. The player's stroke during putting is a result of (1) alignment of the putter head with the ball in the intended direction, (2) the consistency of the movement of the putter head during the back-stroke and the forward-stroke to strike the ball and (3) transfer of the putter head's oscillating movement into forward movement of the golf ball.

To manage these three parameters during a golf stroke, current products rely on (1) visual aids like lines, shapes, and sight-finders; (2) larger hitting faces to allow for greater forgiveness in the putter so that a miss-hit from a golfer has the least amount of resulting penalty in the direction of travel of the golf ball; and (3) inserts or machined features on the face of the putter head that impart the forward motion to the golf ball. By making the hitting face on the putter head larger the golfer is now required to align the golf ball to the center of this large face. To help with alignment, guidelines, shapes and sight-finders are added which simply take the golfer's focus away from the main object—the golf ball. Moreover, the larger head now requires the bottom of the clubface to be rounded which allows the putter to be held at an angle towards or away from the golfer resulting a high chance of either swinging inwards or outwards during a backstroke and forward-stroke. This allowance further decreases the accuracy of the stroke and the ability to strike the golf ball in the intended direction of travel. Further features like inserts and machined surfaces are added on the face of the putter head to reduce the effect of the club face striking the ball with an inward or outward angle.

As such, there is a need for a putter head that improves the golfer's ability to align the putter head to the golf ball, increases the consistency of the golfer's stroke by providing a consistent setup every time while providing tactile feedback that builds muscle memory, and imparts an accurate forward motion to the golf ball upon strike from the putter.

SUMMARY OF THE INVENTION

The invention described herein addresses certain drawbacks of the existing products by simplifying the putter head design. The striking head of the putter head is dimensioned to be generally the same width as the diameter of a golf ball from the golfer's view while setting-up to putt. This allow for easy alignment and maintains the golfer's focus on the ball. The smaller profile of the hitting face of the striking head allows the putter head to have features that create a three-point contact to the ground when the putter head is placed behind the ball. These contact points stabilize the putter head in a perfect flat condition with respect to the ball. One of these points is under the hitting face with the other supporting points along the heel and toe of the putter head to create the stabilizing base. This setup can allow the golfer to setup in the same consistent manner for every putt, having the same perfect alignment and position with respect to the putter. This can provide the base for a consistent pendulum swing that initiates a backstroke with the putter head in a perfectly flat condition and continue the forward-stroke in such condition as well. If the golfer's movement of the putter head shifts the hitting face inwards or outwards, inner-back or outer-back supporting points will drag on the ground providing a subtle tactile feedback to the golfer. During the backstroke, the golfer can correct for this by stopping and re-starting the backstroke. As the golfer uses this putter head, the points of contact on the ground continue to provide the feedback and aide in building the muscle memory on the golfer's swing to create a more consistent backward and forward stroke.

According to another embodiment of the present invention, the striking head portion of the putter head remains dimensioned to be the same width as the diameter of a golf ball from the golfer's view while setting-up to putt, allowing the golfer to readily align the putter with the ball and maintain focus on the ball. The smaller profile of the hitting face of the striking head portion allows the putter head to have features that create a line and four-point contact to the ground when the putter head is placed behind the ball. The line and four-point contact stabilize the putter head in the perfect flat condition with respect to the ball. The contact line is under the hitting face with the other four supporting points on the outer-most corners of the stabilizing base portion. This setup can allow the golfer to setup in the same consistent manner for every putt, having the same perfect alignment and position with respect to the putter. This can provide the base for a consistent pendulum swing that initiates a backstroke with the putter head in a perfectly flat condition and continue the forward-stroke in such condition as well. If the golfer's movement of the putter head shifts the hitting face inwards or outwards, inner-back or outer-back supporting points will drag on the ground providing a subtle tactile feedback to the golfer. During the backstroke, the golfer can correct for this by stopping and re-starting the backstroke. As the golfer uses this putter head, the line and four-base points of contact on the ground continue to provide the feedback and aide in building the muscle memory on the golfer's swing to create a more consistent backward and forward stroke. Furthermore, the center of mass of the putter head is higher than the center of the golf ball during the striking motion and the downward angled hitting face of the putter head is designed to impart a forward rolling motion to the golf ball. The forward rolling motion is known to have a positive effect on the accuracy of the movement of the golf ball as it results in greater interaction with the green surface, which results in the ball getting to a zero-skid condition. It is known that zero skid condition is the true-roll condition of the golf ball on the green surface. The predictability and accuracy of the ball trajectory increases as the distance to zero-skid or true-roll is reduced.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

Figure 1:
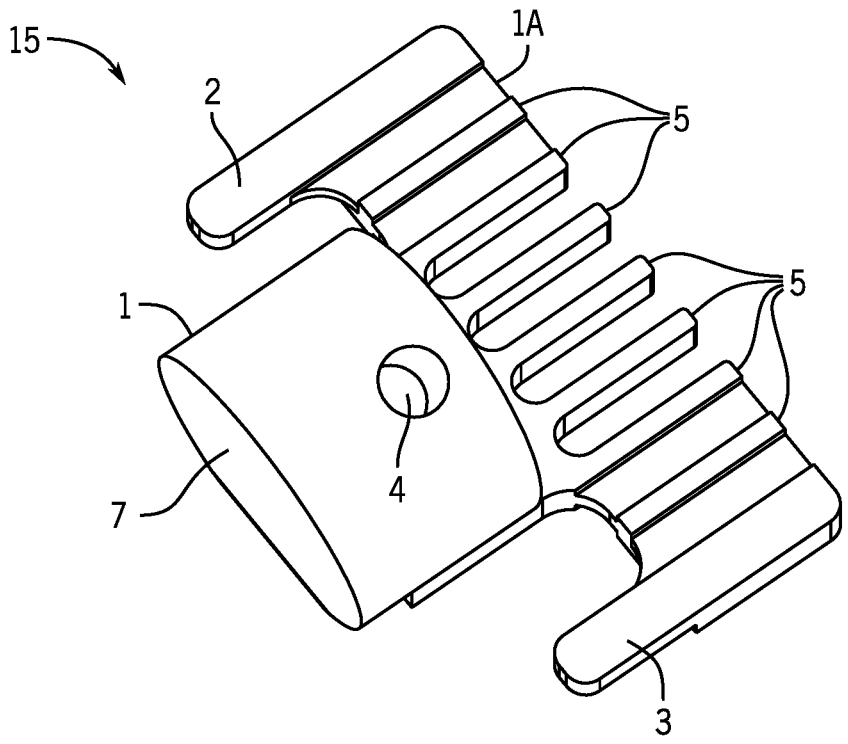
FIG. 1 is a top perspective view of one embodiment of a putter head in accordance with the invention.

The putter head design contains several features that contribute to meeting the function of the putter, to aid the golfer in creating a consistent putter stroke that imparts a consistent forward rolling motion to the golf ball upon strike. FIGS. 1-6 illustrate one embodiment of a putter head 15 in accordance with the invention. The body of the putter head 15 may be comprised of two primary portions: a striking head 1 and a stabilizing base 1A that are connected. The striking head and stabilizing base may be molded as a unitary element or may be separately formed and connected upon assembly. A standard putter shaft (not shown) may be inserted into the striking head 1 as is conventional to complete the putter. The putter head 15 may include a generally flat, angled hitting face or striking surface 7 and a low center of mass (not shown in the drawings) on the striking head 1, three stabilizing protrusions or contact protrusions that serve as contact points with the ground 9, 10, and 11, and a horizontal width of the striking head 1 that generally matches the width of the golf ball for undistracted and easy visual alignment. When the putter head is place upright on a generally flat surface, such as a golf course putting green, contact points 9, 10, 11 will each contact the ground. While one embodiment is depicted in FIGS. 1-6, other configurations could be implemented without departing from the invention, such as the configuration shown in the embodiment depicted in FIGS. 7-11 and described below.

Figure 1A:
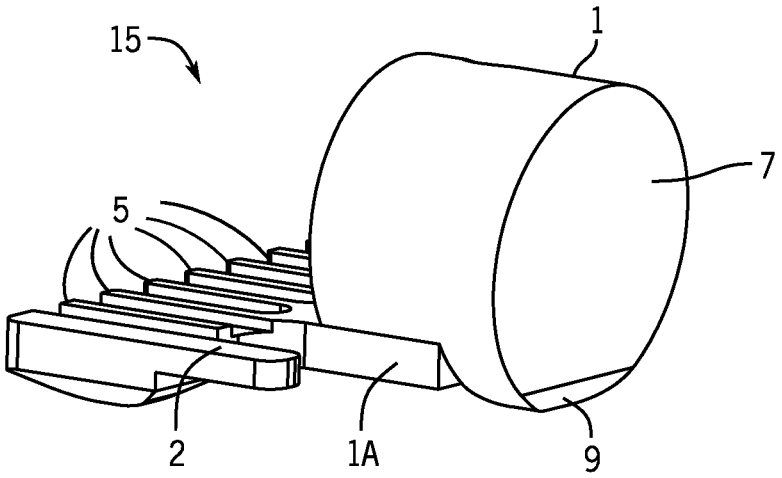
FIG. 1A is a side perspective view of the putter head of FIG. 1.
Figure 1B:
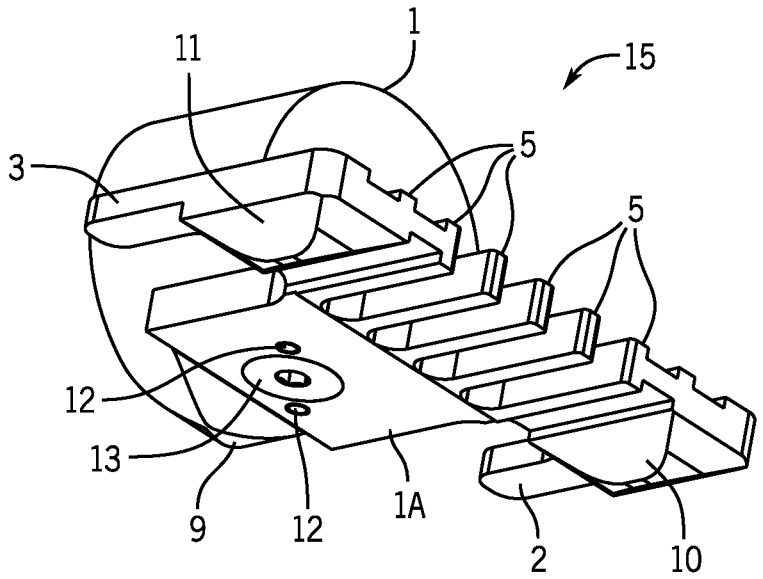
FIG. 1B is a bottom perspective view of the putter head of FIG. 1.
Figure 2:
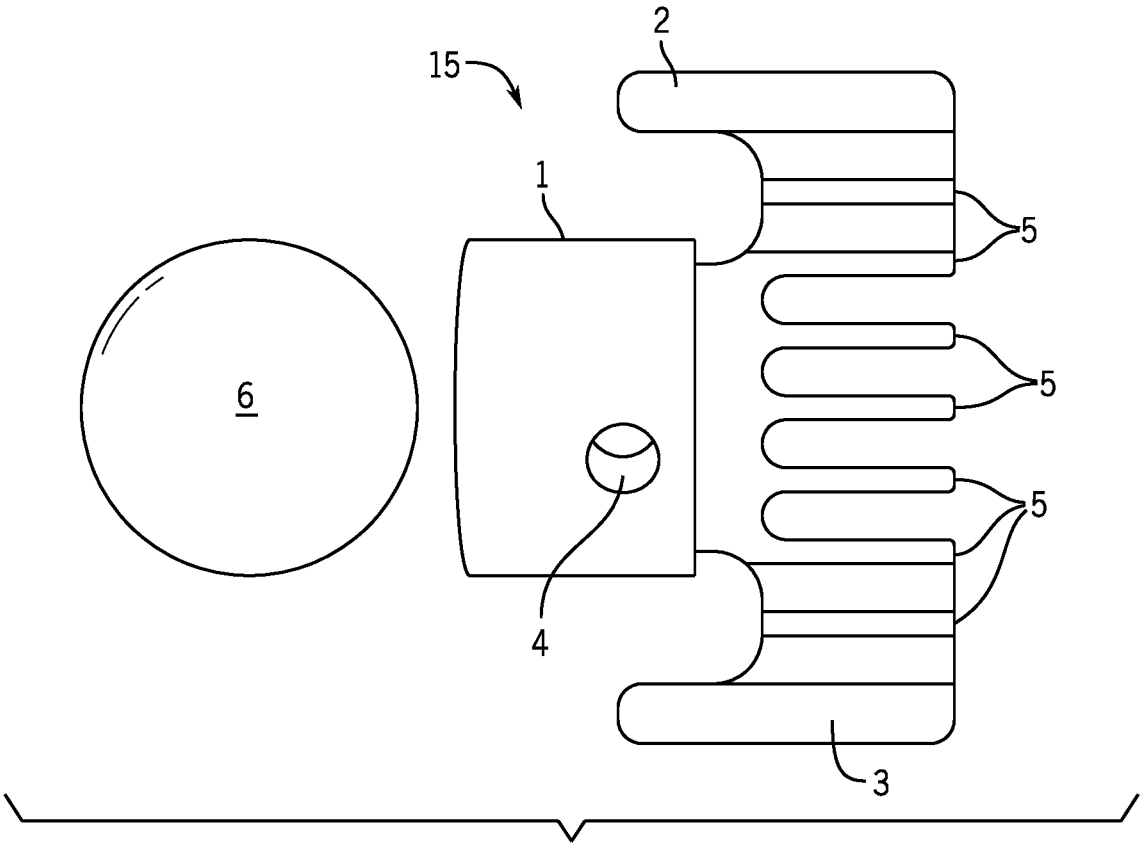
FIG. 2 is a top view of the putter head of FIG. 1 showing the size of the putter head in relation to the size of the golf ball and showing the overall view that the golfer will see when putting.
Figure 3:
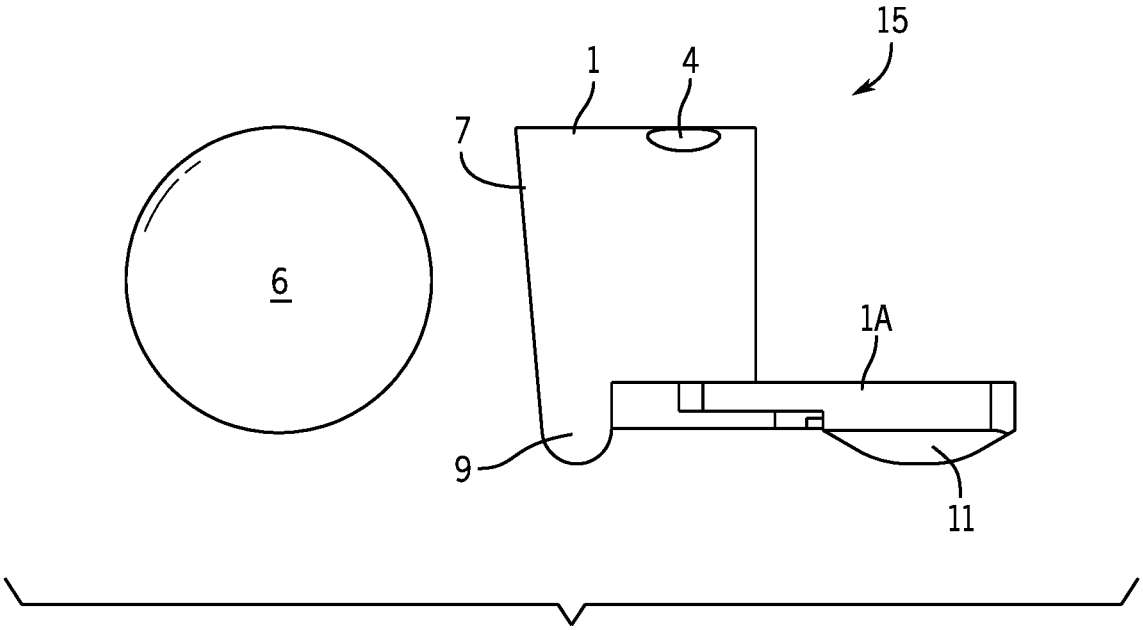
FIG. 3 is a side view of the putter head and golf ball of FIG. 2 showing the angled hitting face and the three contact points where the putter head touches the ground during set-up.

FIGS. 1, 1A, and 1B are perspective views of the putter head 15 showing the striking head 1. With reference to FIG. 2, the striking head 1 is approximately the same diameter as the golf ball 6. Thus, during the address and setup for putting, the golfer's view of the putter head 15 is as shown in FIG. 2, which allows for easy and accurate alignment of the putter head 15 with the golf ball 6 in an inside-to-outside direction. The hitting face 7 of the striking head 1 may be generally cylindrical and the striking head 1 may include a shaft insertion hole 4 where the putter shaft (not shown) may be attached. The location of the shaft insertion hole 4 can be such that the center of the axis of the shaft insertion hole 4 may pass through the center of mass (not shown in the drawings) of the putter head 15. This may give the golfer a neutral feeling when the putter head 15 is moved in a backward direction and off the ground to initiate the backward stroke. The location of the shaft insertion hole 4 as shown in FIG. 1 is designed for right-handed golfers and can be moved along the surface of the cylinder to the other side of the vertical center plane of the striking head 1 for golfers who are left-handed. The putter head 15 along with the shaft insertion hole 4 also features the front contact point 9 on the ground, as shown in FIG. 3. The striking head 1 may be connected to the stabilizing base 1A of the putter head 15 that contains the remaining two contact points 10 and 11 to the ground along with physical sight-lines 2, 3 and 5. The physical sight lines 2, 3, and 5 may be designed so as to not create an unintentional second hitting surface on the putter head 15. In some embodiments, the hitting face of the putter could also have a milled surface or a metallic or non-metallic insert for generally accepted characteristics such as improved feel and sound on impact.

FIG. 2 shows the top view of the putter head 15 that the golfer would see during setup and strike at the time of play. The view shows how the putter head 15 may be generally sized to match the size of the golf ball 6. This sizing assists in alignment using the entire striking head 1 of the putter head 15, rather than a section of the hitting face 7 as is required by most other golf putters that are commercially available. These existing putters rely on sight lines, markings, and sight aides to help the golfer align the putter head to the golf ball to impart the forward momentum in the intended direction upon forward swing into the golf ball. The larger face putters are considered to have a larger forgiving hitting area on the face that tends to correct some of the errors in the golf swing but provides no feedback to the golfer so that the motion of the swing can be adjusted and trained to become more consistent. This forgiveness can lead to building a muscle memory of a non-aligned stroke, making the golfer reliant on the more forgiving hitting face, rather than helping the golfer build a muscle memory of a properly aligned stroke, to aid the golfer even after returning to a standard putter.

In FIG. 2, the physical sight lines 2 and 3 are extensions of the stabilizing base 1A where the main contact points to the ground 10 and 11 exist. Physical sight lines 2 and 3 are not required for the function of the putter, but simply provide a visual aid and add a visual familiarity to the design since most of current putter designs are wide. Other configurations could, of course, be implemented without departing from the invention. The cut-offs and indented lines around physical sight lines 2, 3 and 5 are designed to further provide a visual aid for the golfer to swing in a perfect pendulum motion. One reason for the depicted configuration for the physical sight lines 2, 3, and 5 is to create an uneven surface so that it may not be considered as a secondary hitting surface.

Figure 4:
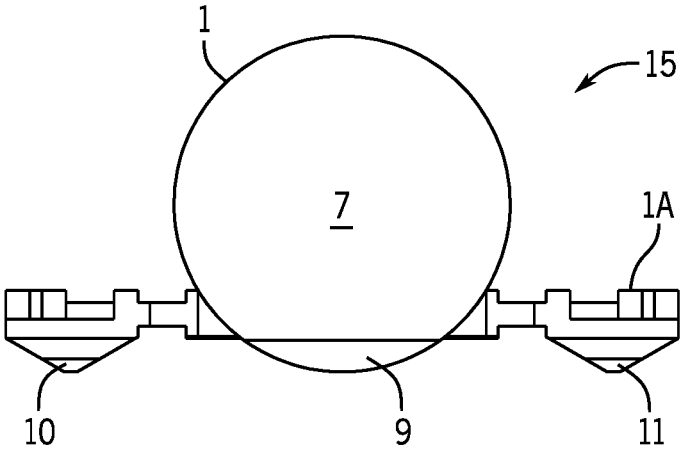
FIG. 4 is a front view of the putter head of FIG. 2 showing the three contact points where the putter touches the ground during set-up.
Figure 5:
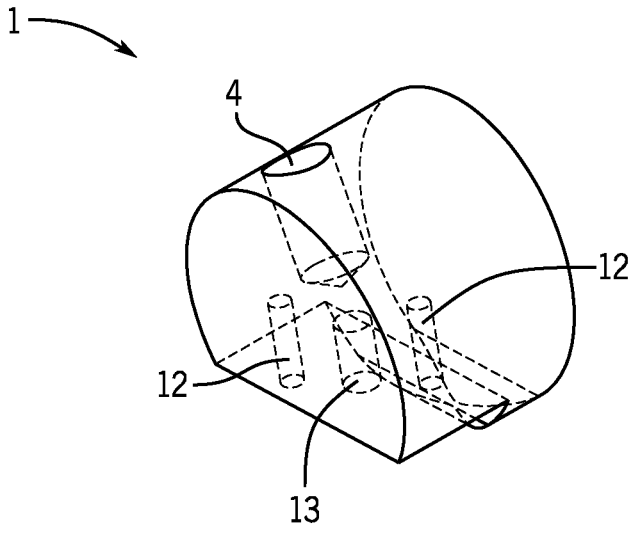
FIG. 5 is a detail top perspective view of the striking head of the putter head of FIG. 1 with dashed lines showing internal structure and hidden edge lines of the striking head.
Figure 6:
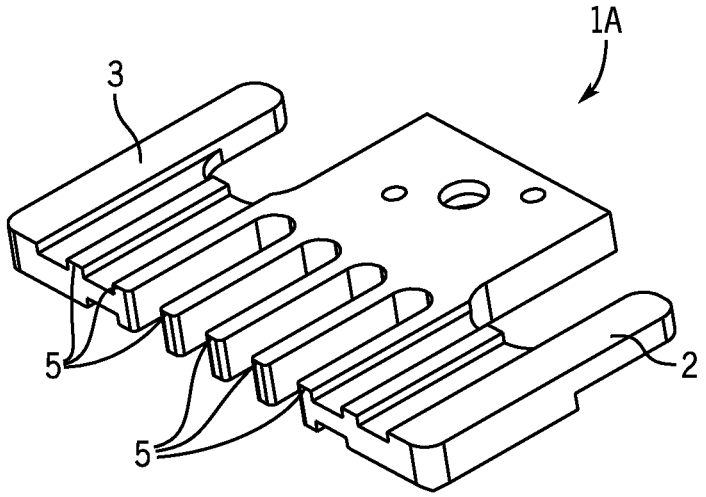
FIG. 6 is a detail top perspective view of the stabilizing base of the putter head of FIG. 1.

FIGS. 3 and 4 show side and front views that illustrate the mechanics of the motion imparted on the golf ball 6 during a strike and the operation of the putter head 15 that provides physical feedback to the golfer of a miss-hit. The hitting face 7, as illustrated, is generally the same height as the golf ball 6 and is angled downward, generating a negative loft. Other configurations, e.g., other negative or zero loft angles, could also be used.

Contact points 9, 10 and 11 create the tactile feedback and consistent setup to the golfer during the backward-stroke and the forward-stroke during play. As the golfer addresses the ball 6, the putter head 15 is allowed to sit on the three contact points 9, 10, and 11, which can create a perfect alignment of the hitting face 7 and the center of mass (not shown on the drawings) of the putter head 15 to the center of the ball 6 in the Z-axis. The y-axis alignment (inside to outside) may be aligned using the striking head 1 as shown in FIG. 2. Once aligned, the golfer can begin the backward stroke. If putter head 15 is tilted towards the golfer, contact point 11 will stay in contact with the ground while contact points 9 and 10 are lifted off the ground. This one-sided resistance provides tactile feedback felt by the golfer through the putter shaft. Contact point 11 is shaped to allow movement of the putter head 15 while ensuring the contact to the ground is not too aggressive as to stop the movement but to provide a subtle resistance. If putter head 15 is tilted away from the golfer, contact point 10 will stay in contact with the ground while contact points 9 and 11 are lifted off the ground. This one-sided resistance provides tactile feedback felt by the golfer through the putter shaft. Contact point 10 can be shaped to allow movement of the putter head 15 while ensuring the contact to the ground is not too aggressive as to stop the movement but to provide a subtle resistance.

During the forward stroke of the putter head 15, the same principles as above apply for the physical feedback to the golfer. If the putter head 15 is tilted towards the golfer, contact point 11 will stay in contact with the ground while contact points 9 and 10 are lifted off the ground. This one-sided resistance provides physical feedback felt by the golfer through the putter shaft. The contact point 11 is shaped to allow the movement of the putter while ensuring the contact to the ground is not too aggressive as to stop the movement but to provide a subtle resistance. If the putter is tilted away from the golfer, contact point 10 will stay in contact with the ground while contact points 9 and 11 are lifted off the ground. This one-sided resistance provides physical feedback is felt by the golfer through the putter shaft. Contact point 10 is shaped to allow the movement of the putter head 15 while ensuring the contact to the ground is not too aggressive as to stop the movement but to provide a subtle resistance.

This physical feedback to the golfer may inform the golfer of an inherent in-swing or out-swing of the putter head 15. This occurs every time the golfer putts and this feedback allows the golfer to make swing adjustments to prevent the one-sided drag of the putter head 15 on the ground. As the golfer continues to use the putter, muscle memory can build and there is much higher potential for the golf swing to improve.

It has been found effective to manufacture the putter head 15 from a metal such as stainless steel, capable of providing sufficient weight to the putter head to allow for slower swing speeds to attain the same distance of the putt compared to a lighter putter. Stainless steel may be found advantageous over regular steel material in terms of its superior corrosion resistance. A putter head 15 made from non-corrosion resistant steel may require an added finish, which could create unintended surface finish. Other materials conforming to the rules of golf could also be used.

The putter head 15 can be made as a unitary single-piece design or a multi-piece design, for instance, with the striking head 1 attached to the stabilizing base 1A using industry standard joining techniques that ensure no added variation in the alignment of the striking head 1 to the stabilizing base 1A. The exemplary embodiment of the putter head 15 depicted is designed to be made from simple machining operations but it could also be created using an alternative process more suited for higher production volumes. Alternative processes could include extrusion of the striking head 1 and a forging or fine blanking process for the stabilizing base 1A. Once the components are made, subsequent machining of features for attaching the stabilizing base 1A to the striking head 1, creating the angle for the hitting face 7, creating the profile of the contact points 9, 10 and 11, and creating the insertion hole 4 for the putter shaft are required to complete the putter head 15. In the exemplary embodiment depicted in the Figures, two dowels 12 and a screw 13 are used to secure the striking head 1 to the stabilizing base 1A. Other attachment techniques, e.g., welding, single-piece casting, other combinations or screws and dowels, or other techniques known in the art, could be used.

FIGS. 7-11 show a second embodiment of a putter head 20 in accordance with the invention Like the previously described embodiment, this embodiment has two connected portions, a striking head portion 21 and a stabilizing base portion 21A. In this embodiment, the striking head portion 21 and the base portion 21A are formed together to result in a single putter head 20 piece. This single-piece configuration may eliminate sound produced by separate, discrete elements moving against one another and may make the putter head 20 less expensive to manufacture. However, in some embodiments, the striking head portion 21 and stabilizing base portion 21A may be separable elements connected to one another by a fastener or other means of connection. A standard putter shaft (not shown) is inserted into the striking head portion 21 as is conventional to complete the putter. In the present embodiment, the putter head 20 includes an generally flat, negative-lofted hitting face or striking surface 27 and a high center of mass 28 on the striking head portion 21, a horizontal width of the striking head portion 21 that generally matches the width of the golf ball 26 for undistracted and easy visual alignment, and a series of stabilizing protrusions—a contact line 29 and four contact points 30, 31, 32, 33 with the ground. When the putter head is place upright on a generally flat surface, such as a golf course putting green, the stabilizing protrusions 29, 30, 31, 32, 33 will each contact the ground. With respect to the center of mass 28, FIG. 10 indicates the position of the center of mass 28 with respect to the vertical axis when the putter is aligned as described herein, and FIG. 11 indicates the center of mass 28 with respect to the horizontal axes. In the embodiment shown, the center of mass 28 is approximately 0.025 inches above the center of mass of the ball 26. However, in other embodiments, the height of the center of mass may vary.

While one embodiment is depicted in FIGS. 7-11, other configurations could be implemented without departing from the invention.

Figure 7:
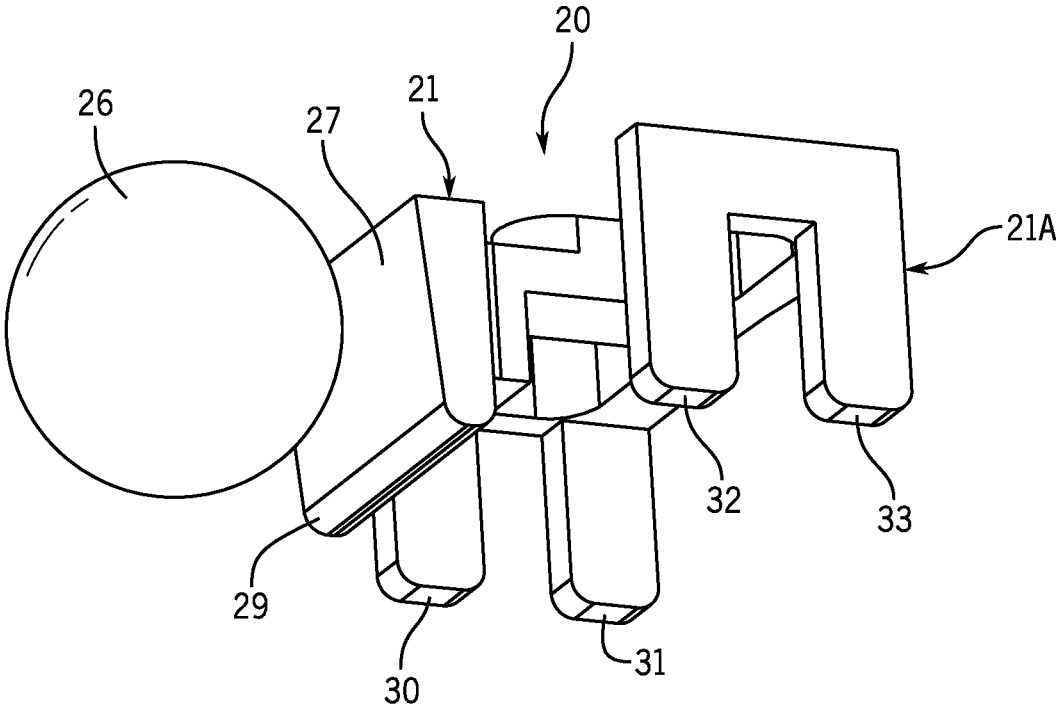
FIG. 7 is a bottom perspective view of another embodiment of a putter head in accordance with the invention.
Figure 8:
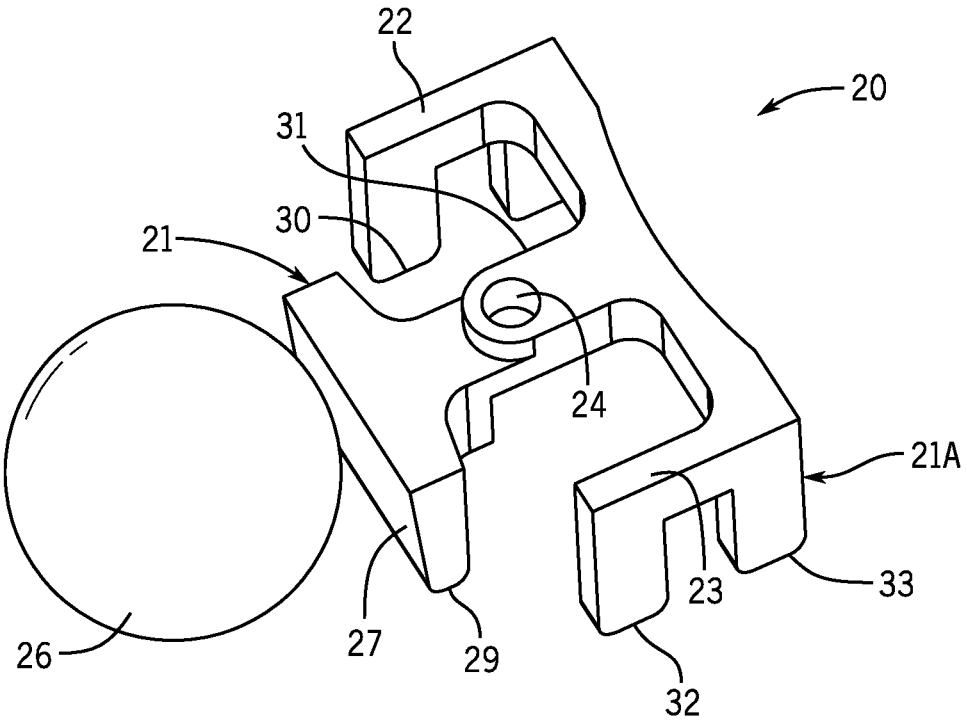
FIG. 8 is a top perspective view of the putter head of FIG. 7.
Figure 9:
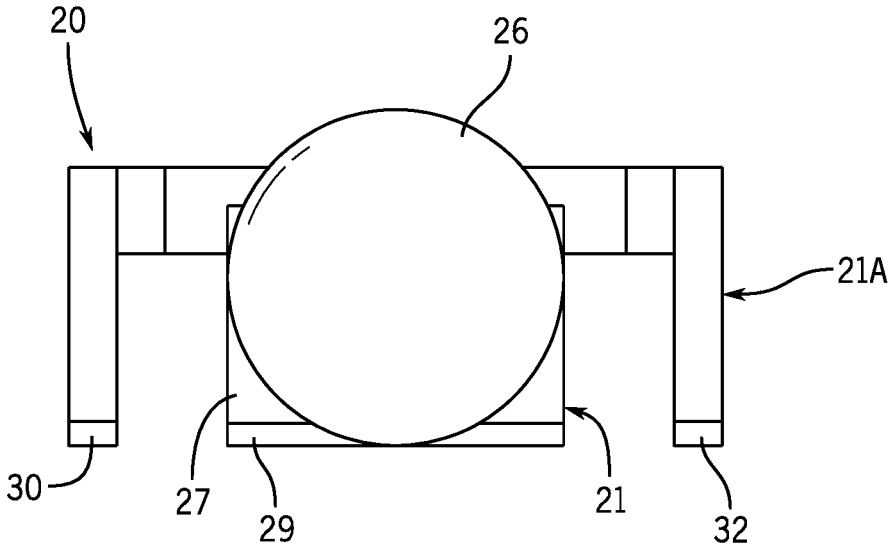
FIG. 9 is a front view of the putter head of FIG. 7 showing two of the contact points and the contact line where the putter touches the ground during set-up.
Figure 10:
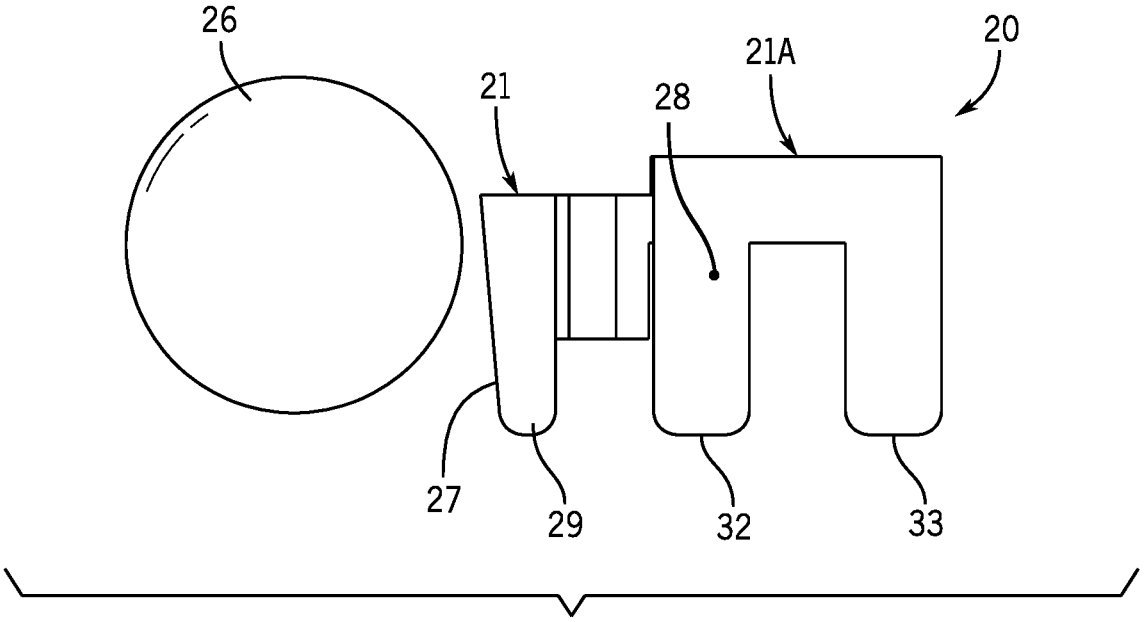
FIG. 10 is a side view of the putter head and golf ball of FIG. 7 showing the angled hitting face and two of the contact points and the contact line where the putter head touches the ground during set-up.
Figure 11:
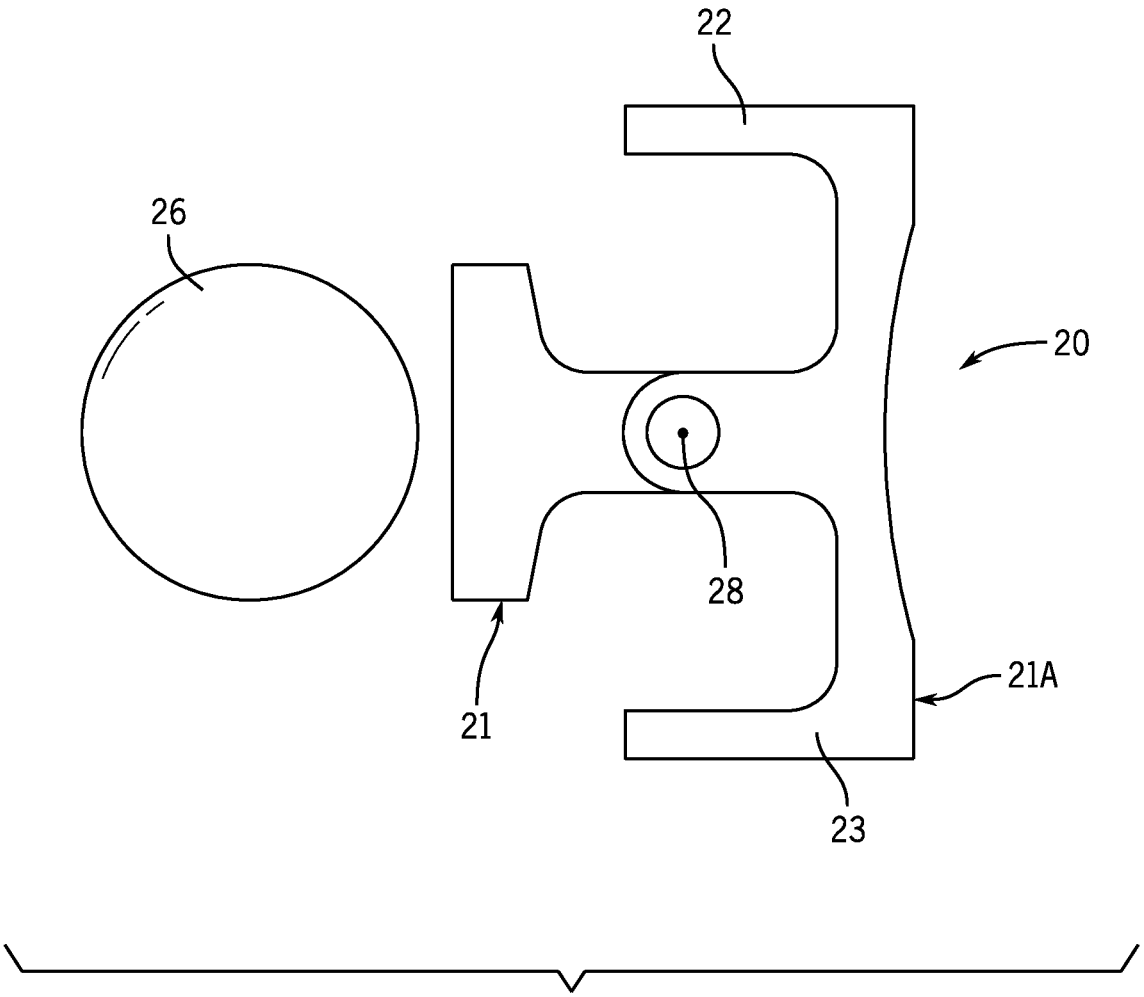
FIG. 11 is a top view of the putter head of FIG. 1 showing the size of the putter head in relation to the size of the golf ball and showing the overall view that the golfer will see when putting.

FIGS. 7 and 8 are perspective view of the putter head 20 showing the striking head portion 21, having a hitting face 27 that is approximately the same width as the golf ball 26. Thus, during the address and setup for putting, the golfer's view of the putter head 20 may be as shown in FIG. 11, which allows for easy and accurate alignment of the putter head 20 with the golf ball 26 in an inside-to-outside direction. The hitting face 27 of the striking head portion 21 may be generally rectangular, as shown in FIGS. 7-8. Further, the stabilizing base portion may include a shaft insertion hole 24 where the putter shaft (not shown) may be attached. In the present embodiment, the location of the shaft insertion hole 24 is such that the center of the axis of the shaft insertion hole 24 goes through the center of mass 28 (see FIGS. 10 and 11) of the putter head 20. This can give the golfer a neutral feeling when the putter head 20 is moved in a backward direction and off the ground to initiate the backward stroke. The location of the shaft insertion hole 24, as shown in FIGS. 8 and 11, is designed to accommodate either right or left-handed golfers and to accommodate bent shafts at various angles to fit different golfers. The putter head 20, along with the shaft insertion hole 24, may also feature the contact line 29 on the ground, as shown in FIGS. 7 and 9-10. In the embodiment shown in FIGS. 7-11, the striking head portion 21 is connected to the stabilizing base portion 21A of the putter head 20 that includes the remaining two contact points 30, 31, 32, and 33 to the ground, along with physical sightlines 22 and 23.

FIGS. 9 and 10 show front and side views that illustrate the mechanics of the motion imparted on the golf ball 26 during a strike and the operation of the putter head 20 that provides tactile feedback to the golfer of a miss-hit. As in the earlier described embodiment, the hitting face 27 of the present embodiment may be generally the same height as or greater than one-half of the diameter of the golf ball 26 and angled downward, i.e. negative lofted. Other configurations, e.g., other negative or zero loft angles, could of course be used. In the embodiment shown in FIGS. 7-11, the center of mass 28 of the putter head 20 is also higher than the center of the golf ball 26. The combination of a negative-lofted hitting face 27 and a higher center of mass 28 is designed to impart a forward rolling motion like a top spin on the golf ball 26 when struck by the hitting face 27. This rotational motion of the golf ball 26 along with the imparted linear motion from the hitting face 27 of the putter head 20 provides a dominant motion to the ball 26 that reduces the chances of the ball 26 spinning towards or away from the golfer which could lead to an unintended curve in the trajectory of the ball 26 as the linear motion of the ball 26 slows down. This top spin can also reduce the distance the ball travels to attain zero skid (true-roll) movement. A zero-skid movement is important for the ball to follow the contour of the green, thus creating a more predictable and accurate ball trajectory. The hitting face of the putter could also have a milled surface or a metallic or non-metallic insert for generally accepted characteristics such as improved feel and sound on impact.

FIG. 11 shows the top view of the putter head 15 that the golfer would see during setup and strike at the time of play. The view again shows how the putter head 20 in this embodiment is generally sized to match the size of the golf ball 26. This sizing assists in alignment using the entire striking head portion 21 of the putter head 20, rather than using just a section of the hitting face 27, as is required by most other golf putters that are commercially available. These existing putters rely on sight lines, markings and sight aides to help the golfer align the putter head to the golf ball to impart the forward momentum in the intended direction upon forward swing into the golf ball. The larger face putters currently on the market are considered to have a larger forgiving hitting area on the face that tends to correct some of the errors in the golf swing, but these putters provides no feedback to the golfer so that would allow the motion of the swing to be adjusted and trained for increased consistency. This forgiveness can lead to building a muscle memory of a non-aligned stroke, making the golfer reliant on the more forgiving hitting face, rather than helping the golfer build a muscle memory of a properly aligned stroke, to aid the golfer even after returning to a standard putter.

In FIG. 11, the physical sight lines 22 and 23 are extensions of the stabilizing base portion 21A where the main contact points to the ground 30, 31, 32, and 33 are found. Physical sight lines 22 and 23 are not required for the function of the putter but provide a visual aid and add a visual familiarity to the design since most of current putter designs are wide. Other configurations could, of course, be implemented without departing from the invention. Additionally, in some embodiments, the rear of the stabilizing base portion 21A is curved, as shown in FIG. 11. One reason for the depicted curved configuration is to create an uneven surface so that this surface may not be considered as a secondary hitting surface. A curved configuration is not the only configuration that may accomplish this; other configurations, such as the configuration of sight lines 2, 3, and 5 of the previously described embodiment, may likewise serve to avoid user confusion as to the intended striking face. In other embodiments, this face may be flat and an indication as to which face is the proper hitting face may be translated through other means, such as written instructions on or inside the product packaging or an instructional indicator attached to or engraved into one or both of the putter faces.

During use, contact line 29 and contact points 30, 31, 32, and 33 create the stable platform for the putter. This platform provides stable and consistent setup for the golfer. The golfer simply must ensure that all points 29, 30, 31, 32 and 33 are in-contact with the ground during address. Once in contact, the shaft angle can determine the position of the golfer with respect to the putter. Since the position of the putter and the golfer can be determined by physical functional elements of the putter, this setup can be consistent at every putt. This consistent setup should lead to a consistent swing. A tactile feedback to the golfer during the backward-stroke and the forward-stroke during play is also felt. As the golfer addresses the ball 26, the putter head 20 may be allowed to sit on the three contact line 29 and contact points 30, 31, 32, and 33, which creates a beneficial alignment of the hitting face 27 and the center of mass 28 with respect to the center of the ball 26. The y-axis alignment (inside to outside) can be aligned using the striking head portion 21, as shown in FIG. 11. Once aligned, the golfer can begin the backward stroke. If putter head 20 is tilted towards the golfer, contact points 32 and 33 will stay in contact with the ground while contact points 30 and 31 are lifted off the ground. This one-sided resistance provides physical feedback felt by the golfer through the putter shaft. Contact points 32 and 33 are shaped to allow subtle resistance to the movement of the putter head 20, while ensuring the contact to the ground is not too aggressive as to stop the movement. If putter head 20 is tilted away from the golfer, contact points 30 and 31 will stay in contact with the ground while contact points 32 and 33 are lifted off the ground. This one-sided resistance provides physical feedback felt by the golfer through the putter shaft. Contact points 30 and 31 are likewise shaped to allow subtle resistance to the movement of the putter head 20, while ensuring the contact to the ground is not too aggressive as to stop the movement.

During the forward stroke of the putter head 20, the same principles as above apply for the physical feedback to the golfer. If the putter head 20 is tilted towards the golfer, contact points 32 and 33 will stay in contact with the ground while contact points 30 and 31 are lifted off the ground. This one-sided resistance provides physical feedback felt by the golfer through the putter shaft. The contact points 32 and 33 are shaped to allow subtle resistance to the movement of the putter head 20, while ensuring there the contact to the ground is not too aggressive as to stop the movement. If the putter is tilted away from the golfer, contact points 30 and 31 will stay in contact with the ground while contact points 32 and 33 are lifted off the ground. This one-sided resistance provides physical feedback is felt by the golfer through the putter shaft. Contact points 30 and 31 are shaped to allow subtle resistance to the movement of the putter head 20, while ensuring the contact to the ground is not too aggressive as to stop the movement.

This physical feedback to the golfer informs the golfer of an inherent in-swing or out-swing of the putter head 20 every time the golfer putts, and this feedback allows the golfer to make swing adjustments to prevent the one-sided drag of the putter head 20 on the ground. As the golfer continues to use the putter, muscle memory builds, and there is much higher potential for the golf swing to improve.

It has been found effective to manufacture the putter head 20 from low carbon steel, which can provide a lighter weight to golfers who prefer a lighter swing, and to finish the putter head 20 with e-coat or powder coating. Other materials conforming to the rules of golf could also be used. The putter head 20 can be made as a unitary single-piece design or a multi-piece design with the striking head portion 21 attached to the stabilizing base portion 21A using industry standard joining techniques that ensure there is no added variation in the alignment of the striking head portion 21 to the stabilizing base portion 21A. The exemplary embodiment of a putter head 20, depicted here, is designed to be made from simple machining operations, though it could also be created using an alternative process more suited for higher production volumes. Alternative processes could include extrusion, casting with secondary machining, forging, or fine blanking process. Once the components are made, subsequent machining of features for attaching the stabilizing base portion 21A to the striking head portion 21, creating the angle for the hitting face 27, creating the profile of the contact line 29 and contact points 30, 31, 32, 33, and creating the insertion hole 24 for the putter shaft are required to complete the putter head 20 shown in FIGS. 7-11. Other techniques, e.g., welding, single-piece casting, combinations of screws and dowels, or other techniques known in the art, could be used to connect the striking head portion 21 to the stabilizing base portion 21A in a single or multi-piece configuration.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A putter head comprising:

a stabilizing base portion including:

a first sight line portion formed in the stabilizing base portion, a second sight line portion formed in the stabilizing base portion parallel to the first sight line portion;

a first contact protrusion extending from the first sight line portion, a second contact protrusion extending form the first sight line portion, spaced apart from the first contact protrusion, a third contact protrusion extending from the second sight line portion, a fourth contact protrusion extending form the second sight line portion, spaced apart from the third contact protrusion; and a striking head portion connected to the stabilizing base portion, the striking head portion including:

a negative-lofted hitting face configured to impart a forward rolling motion on a golf ball struck by the hitting face, and a fifth contact protrusion formed beneath the angled hitting face, wherein upright placement of the putter head on a generally flat surface places the first, second, third, fourth, and fifth contact protrusions in physical contact with the surface.

2. The putter head of claim 1, wherein the fifth contact protrusion extends across the horizontal width of the negative-lofted hitting face.

3. The putter head of claim 2, wherein the stabilizing base portion is mechanically connected to the striking head portion.

4. The putter of claim 3, wherein an opening sized to receive a putter shaft is formed in the stabilizing base portion.

* * * * *